US012471648B2

(12) United States Patent
Winthrop et al.

(10) Patent No.: US 12,471,648 B2
(45) Date of Patent: Nov. 18, 2025

(54) PATIENT GOWN

(71) Applicant: Winthrop Innovations, LLC, West Palm Beach, FL (US)

(72) Inventors: Neil Winthrop, West Palm Beach, FL (US); Kimberly Winthrop, West Palm Beach, FL (US); Amy Winthrop, West Palm Beach, FL (US)

(73) Assignee: Winthrop Innovations, LLC, West Palm Beach, FL (US)

( * ) Notice: Subject to any disclaimer, the term of this patent is extended or adjusted under 35 U.S.C. 154(b) by 73 days.

(21) Appl. No.: 18/618,402

(22) Filed: Mar. 27, 2024

(65) Prior Publication Data

US 2024/0225150 A1 Jul. 11, 2024

Related U.S. Application Data

(63) Continuation-in-part of application No. 17/493,892, filed on Oct. 5, 2021, now abandoned.

(60) Provisional application No. 63/087,440, filed on Oct. 5, 2020.

(51) Int. Cl.
*A41D 13/12* (2006.01)
*A44B 17/00* (2006.01)

(52) U.S. Cl.
CPC ..... *A41D 13/1236* (2013.01); *A44B 17/0035* (2013.01)

(58) Field of Classification Search
CPC ..... A41D 13/1209; A41D 13/1236; A41D 13/1245; A41D 13/1254; A41D 13/1263; A41D 13/1281; A41D 13/129
See application file for complete search history.

(56) References Cited

U.S. PATENT DOCUMENTS

| | | | |
|---|---|---|---|
| 1,462,515 | A | 7/1923 | McElroy |
| 1,489,046 | A | 4/1924 | Thompson |
| 3,339,209 | A | 9/1967 | Larson |
| 3,803,640 | A | 4/1974 | Ericson |
| 4,547,907 | A | 10/1985 | Netsky |
| 4,837,863 | A | 6/1989 | Van Scoy-Mosher |
| 4,964,173 | A | 10/1990 | Gordon et al. |
| 5,062,159 | A | 11/1991 | Jakub |
| 5,133,086 | A | 7/1992 | Truitt et al. |
| 5,150,477 | A | 9/1992 | Elberson et al. |
| 5,274,852 | A | 1/1994 | Hogan |
| 5,553,323 | A | 9/1996 | Chou et al. |
| 5,991,923 | A | 11/1999 | Maria |
| 6,012,166 | A | 1/2000 | Burbidge |
| 6,499,143 | B2 | 12/2002 | Garza |
| 7,181,773 | B1 | 2/2007 | Piraka |
| 8,161,573 | B1 | 4/2012 | Burns-Cox |
| 9,521,871 | B2 | 12/2016 | Bolla |
| D785,285 | S | 5/2017 | Shamsid-Deen |
| D802,884 | S | 11/2017 | Bennett |
| 10,264,831 | B1 | 4/2019 | Hemker |
| 10,638,803 | B2 | 5/2020 | Graham |
| D894,533 | S | 9/2020 | Pfohl |

(Continued)

FOREIGN PATENT DOCUMENTS

FR 2908271 5/2008

*Primary Examiner* — Sally Haden
(74) *Attorney, Agent, or Firm* — McHale & Slavin, P.A.

(57) ABSTRACT

Medical gown for adults, children and infants having ease of access for medical treatment scenarios when access to portions of a patient's body are necessary without disrupting the patient or causing embarrassment to the patient. The medical gown decreases the possibility of nosocomial infections.

13 Claims, 6 Drawing Sheets

(56) References Cited

U.S. PATENT DOCUMENTS

| | | | |
|---|---|---|---|
| 2003/0051287 | A1 | 3/2003 | Hatton |
| 2006/0253953 | A1 | 11/2006 | Williams |
| 2007/0130668 | A1 | 6/2007 | Berman et al. |
| 2010/0042051 | A1 | 2/2010 | Walker |
| 2011/0186057 | A1 | 8/2011 | Hatton |

PATIENT GOWN

PRIORITY CLAIM

In accordance with 37 C.F.R. § 1.76, a claim of priority is included in an Application Data Sheet filed concurrently herewith. Accordingly, the present invention claims priority as a continuation-in-part (CIP) of U.S. patent application Ser. No. 17/493,892 entitled "PATIENT GOWN", filed Oct. 5, 2021, which claims priority to U.S. Provisional Patent Application No. 63/087,440, entitled "PATIENT GOWN," filed Oct. 5, 2020. The contents of the above referenced applications are incorporated herein by reference.

FIELD OF THE INVENTION

The present invention relates to medical gowns and, in particularly, a garment for patients having ease of access for medical treatment scenarios wherein access to sections of a patient's body are necessary without garment removal or patient embarrassment.

BACKGROUND OF THE INVENTION

A garment commonly worn by patients in a doctor's office or hospital is a gown that covers the frontal area of a patient and, if tied properly, the back of the patient. Such garments are functional in that they provide medical personnel access to the patient's torso for examination or medical procedures. For instance, such a garment provides ease of access to sections of the patient's body for performing numerous functions including: medical examinations, application or attachment of various medical devices or apparatuses to the patient's body, taking vital signs, insertion or removal of intravenous lines (which are the largest reason for hospital acquired infections—also known as nosocomial), or attachment and removal of cardiac monitoring apparatus, surgical procedures, and so forth. Such garments are supposed to allow the above functions without causing discomfort, unnecessarily exposing the patient's body or causing the inconvenience of having to disrobe in order for the medical professional to perform the required duties. Unfortunately, such garments provide little privacy to the patient as they fit poorly, and most any movement leads to torso exposure, which can be humiliating to the patient.

In addition, access to the patient's upper torso requires garment removal, wherein a patient must insert or withdraw their arm through an armhole. This can be difficult if the patient has limited mobility. Even if the patient is mobile, insertion or removal of an arm from the garment requires the patient to expose their entire upper torso as the garment must be untied from the patient's backside. Simple medical procedures, such as placing EKG electrodes, require near total garment removal.

What is needed in the industry is a garment that can be easily attached to an individual with minimal arm movement, provide ease of access to portions of the patient's body by health care professionals, and prevent patient embarrassment.

SUMMARY OF THE INVENTION

Disclosed is a medical gown in the style of a cape or kimono, which may be constructed of either reusable fabric or disposable paper material. In one embodiment, the gown has a centrally located neck opening with two front panels and a rear panel, all of which are horizontally attached at the shoulders on either side of the neck opening. Once draped over the shoulders of the patient, the shoulder portions form open arm holes that have no barrier under the armpit, which may allow the health care professional to insert or attach medical devices or equipment without the patient having to remove his or her arm from the gown. At least one panel wraps around the front of the individual, allowing movement of the shoulder portions. The panel extends can be attached to either the left or right side of the gown and partially wrap, in the manner of a robe, using tie straps, snaps, or hook & loop fasteners to provide closure around the waist of the patient.

An objective of the invention is to provide a medical gown in the form of a shirt top, where either side of a patient's torso can be accessed for limiting exposure of the patient's body for certain examinations or procedures, and minimize arm movement which is critical post surgical procedures.

Another objective of the invention is to provide a medical gown which protects the privacy of, and prevents embarrassment to, a patient having to undergo medical treatment or procedures where portions of the body may be exposed during treatment, while also providing ease of access to portions of a patient's body by health care professionals for certain examinations or procedures.

Another objective of the invention is to eliminate the need to disconnect a patient's IV line, central lines, or arterial lines during attaching or removal of a medical gown, decreasing the likelihood of infection and thereby potentially decreasing the length of hospital stay.

Still another objective of the invention is to provide a gown with multi-purpose pockets, such as holding of drip containers, drains or the like.

Another objective of the invention is to provide a medical gown for a patient which has a section attached to the inner rear panel which may be placed between the patient's legs from the rear and raised up to the patient's waist area and attached by tie straps, hook & loop (Velcro), or snaps around the waist, in the manner of a pair of faux shorts that cover the patient, providing less embarrassment and retaining the dignity of the patient.

Another objective is to provide an embodiment wherein a rear portion of a pair of faux shorts may be attached to the back panel with the front panel attached at one side panel and the other side unattached in order to wrap around the front waist/upper leg portion of the patient and be attached on the other side by use of Velcro or snap type fastening straps.

A further objective of the invention is to provide a medical gown for female patients in the form of a jumper type dress having two front panels and a rear panel, all attached horizontally at the shoulders, which, when draped over the shoulders forms an open neck hole having a wrap-around skirt attached to the rear panel and, when wrapped around the waist of the patient, is secured by Velcro or snaps. Once the skirt is attached, the front panels may be inserted or tucked into the front section of the skirt or attached by Velcro or snaps.

Yet another objective of the invention is to provide a medical gown for infants having a back panel with an attached bottom diaper flap, wherein the front panels are folded over the shoulders of the infant and secured to the back panel by use of Velcro fasteners on the diaper flap or snaps.

Other objectives and advantages of this invention will become apparent from the following description, taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DESCRIPTION OF THE PREFERRED EMBODIMENT OF THE INVENTION

Figures 1, 2, 3:
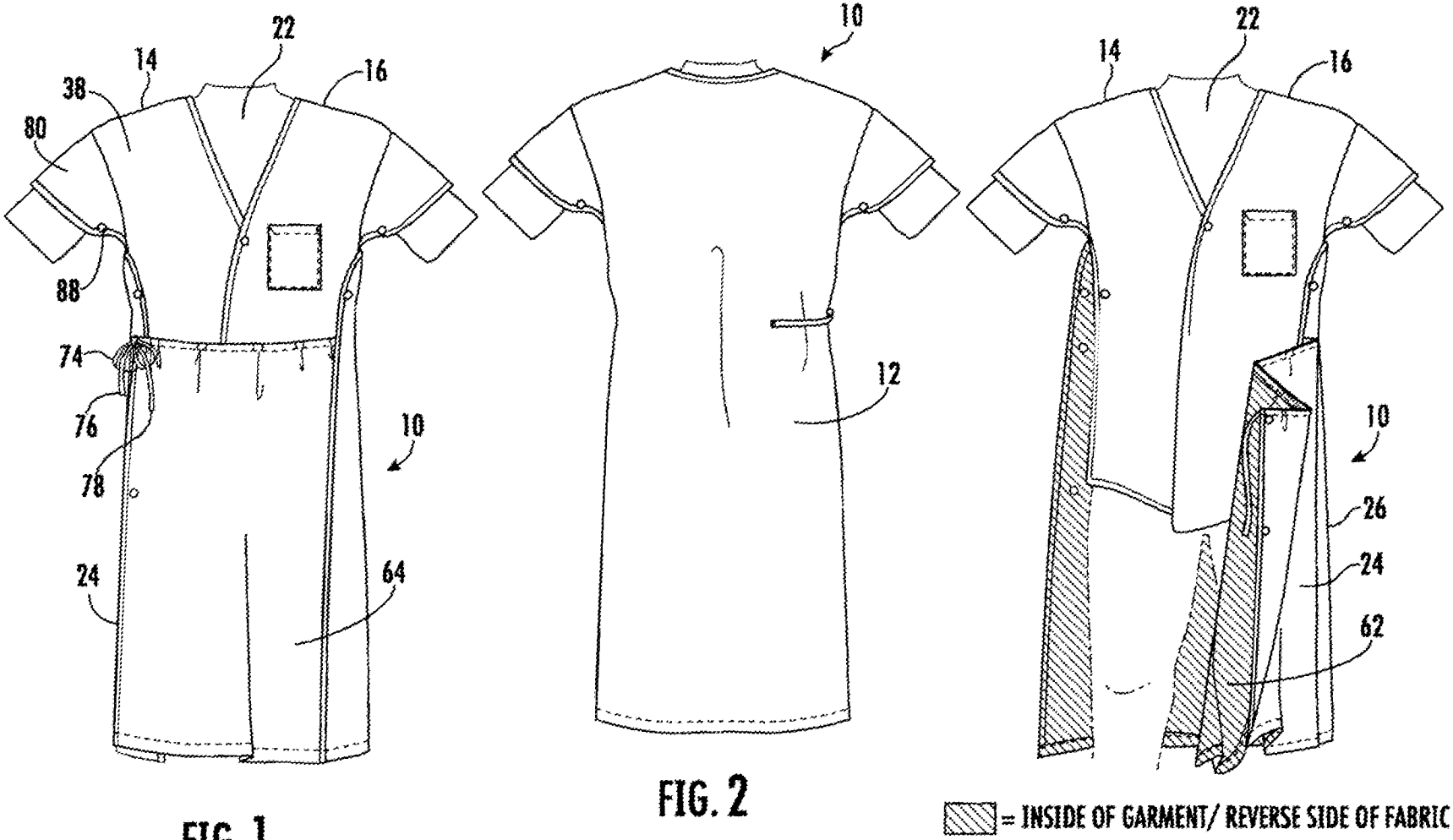
FIG. 1 is a front view of the gown in a closed position.
FIG. 2 is a rear view of the gown.
FIG. 3 is a front view of the gown with the hip flap in an open position.
Figure 4:
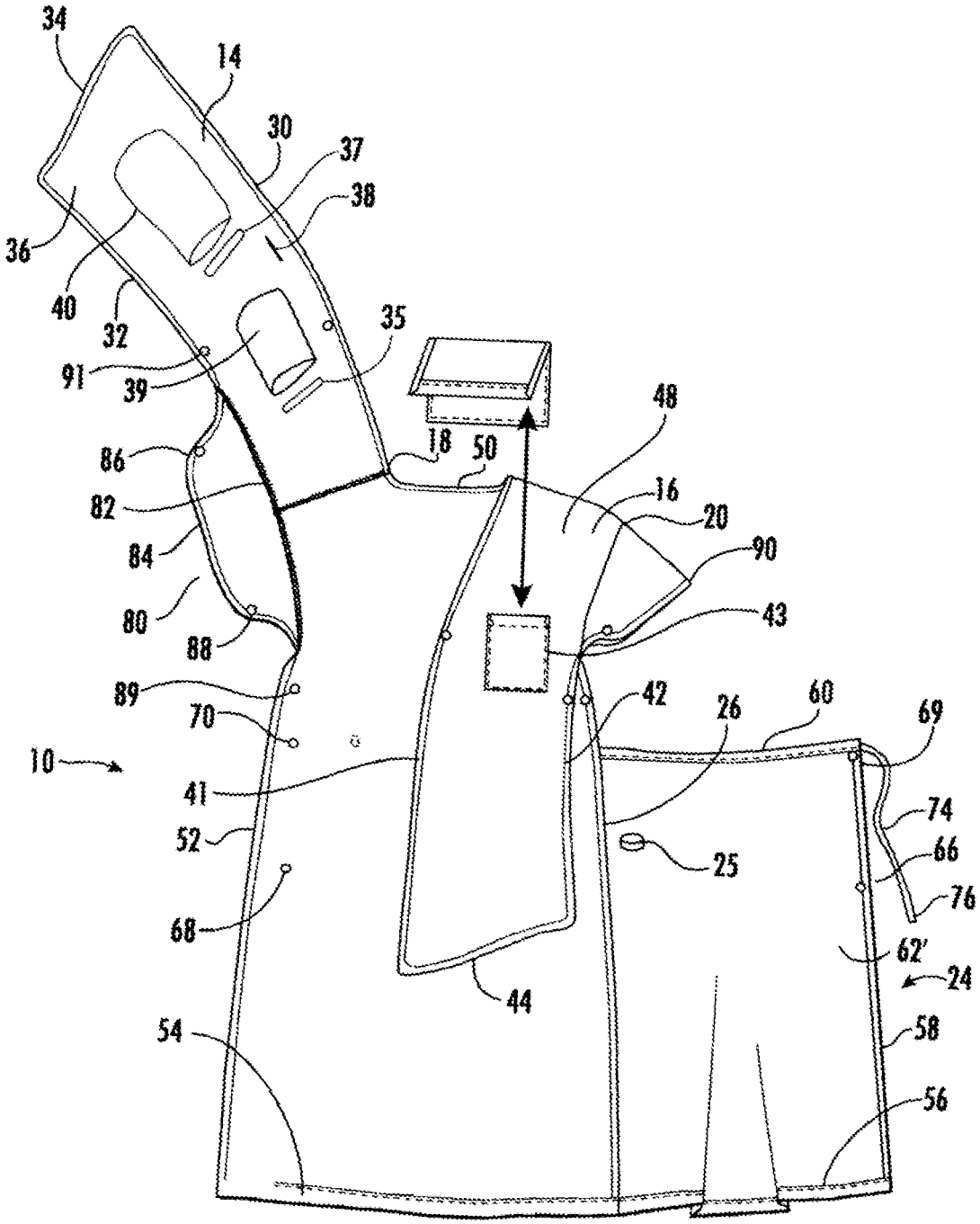
FIG. 4 is a front view of the gown with one shoulder portion in a raised position.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring to FIGS. 1-4, illustrated is a preferred embodiment of a hospital gown assembly 10 having a rear panel 12 and left and right front panels 14 and 16.

In one embodiment, the gown assembly 10 may be formed from washable/reusable fabric. Cotton is a breathable fabric that is comfortable for patients to wear. It can withstand repeated washing and drying cycles without losing its shape or integrity. Additionally, cotton is hypoallergenic, making it suitable for patients with sensitive skin. Blending polyester with cotton can enhance the durability and wrinkle resistance of the fabric while retaining the breathability and comfort of cotton. Polyester-cotton blends are easy to care for and maintain. Polyester is a synthetic fabric known for its durability. It is also quick-drying, which is beneficial for reusable gowns that need frequent washing. However, polyester may not be as breathable as natural fibers like cotton. Polypropylene is a lightweight and moisture-resistant synthetic material that can use for gowns. Polypropylene provides a barrier against fluids and contaminants and is easy to clean and sterilize. However, polypropylene may not be as soft or comfortable as cotton or polyester and seams employed would need to be welded together.

Alternatively, hospital grade paper can be used with the benefit that the paper gown is disposable after one use, wherein left and right front panels 14 and 16 are folded at the shoulder seams or folds 18 and 20, forming a neck opening 22. Hospital grade paper is made from material such as non-woven polypropylene or a blend of cellulose and polyester fibers. Paper gowns are disposable.

All sewn seams used for resusable fabric described herein, including seams 18 and 20, are formed by sewing adjacent panels, such as left front panel 14 to back panel 12, or right front panel 18 to rear panel 12 from thread material selected from the group consisting of cotton, polyester, wool, nylon and blends thereon. The seam is formed by a sewing technique such as lockstitch, chainstitch, or overlock stitch.

A hip cover flap 24 is vertically attached by heat sealing adhesive, or sewn using the thread material and technique described above to a side of the rear panel 12; in one embodiment, the hip cover flap 24 is attached to a right depending side edge 26 of rear panel 12. The left front panel 14 is attached along the shoulder seam 18; the left front panel being defined by an inner edge 30, an outer edge 32 and an end edge 34, forming an inner surface 36 and an outer surface 38. The inner surface 36 depicts two inner pockets 39, 40 to carry items such as cardiac monitor transmitters, drain bags, JP drains, or any other device that needs to be held. A first slit 35 may be placed near the first inner pocket 39; a second slit 37 may be placed near the second inner pocket 40. The slits 35, 37 are openings that allow EKG leads to be drawn through the gown assembly for attaching to an EKG patient monitoring device. Similarly, an outer pocket 43 may be placed on the outer surface 38 of the panel as illustrated. An outer pocket is versatile in use, including use as drip receivers. The number of pockets, if any, placed on the inner surface or the outer surface of the panel is at the election of the manufacture, allowing for any combination of pockets. For ease of illustration, a pocket is only shown on the left front panel 14. The left and right front panel may form a mirror image or a selection of pockets may be placed on either the left or right front panel. It is noted that the gown assembly 10 is reversible allowing the gown to be positioned backwards to that as depicted wherein a patient may be positioned on their abdomen providing access to the posterior side of the patient, maintaining the same ease of access as previous described.

The right front panel 16 is attached along the shoulder seam 20; the right front panel 16 being defined by an inner edge 41, an outer edge 42 and an end edge 44, forming an inner surface, not shown, and an outer surface 48; the inner surface forming a duplicate of the left front panel 14 inner surface 36, and may include pockets to carry items similar to previously described pockets 39, 40.

The rear panel 12 is defined by the left shoulder seam 18 spaced apart from the right shoulder seam 20 by a u-shaped neck edge 50. The neck edge 50 and inner edges 30, 41 form the neck opening 22. A left depending edge 52 extends from the left shoulder seam 18 to a bottom edge 54. A right depending edge 26 extends from the right shoulder seam 20 to the bottom edge 54. The hip cover flap 24 has a lower edge 56 extending the length of the bottom edge 54 to a side edge 58. The end edge 34 of the left front panel 14 and the end edge 44 of the right front panel 16 extend beyond the upper edge 60 of the hip cover flap 24 a minimum length. Extending beyond the upper edge 60 is further defined as having a length of at least 10 inches to cover an individual's private parts when the hip cover flap 24 is placed in an open position such as that illustrated in FIG. 4 wherein said left and right front panels 14, 16 have an end edge 34, 44 that extend beyond the upper edge 60 of said hip cover flap 24 in a ratio of at least 3:1 wherein the length of the front panels extend beneath and beyond the upper edge 60 of the hip cover flap 24 upper edge 60. For example, if a large gown is sized, the upper edge 60 would be about 33 inches long and the end edges 34, 44 would extend beyond the upper edge 60 with the hip cover flap 24 is closed by at least 11 inches. If a small gown is sized, the upper edge 60 would be about 20 inches long and the end edges 34, 44 would extend beyond the upper edge 60 with the hip cover flap 24 closed by at least 6 inches.

Should an inguinal, ventral or femoral hernia inspection be required on one side of a patient's groin, the end edge 34 can be positioned so that the left front panel 14 can be positioned to isolate the area. Similarly, should a hernia inspection be required on an opposite side of the groin, the end edge 44 can be positioned so that the right front panel 16 can be positioned to isolate the area providing privacy for the individual. Even various surgical techniques, such as inspecting the condition of the heart wherein a camera or catheter is guided through a groin positioned blood vessel allows the patient to retain privacy. The dimensional length of the end edges 34, 44 extending beneath the upper edge of the hip cover flap 24 can vary based upon the size of the gown assembly 10, wherein the sizes may be petite, small, medium, large, extra large and so forth. The cover flap 24 securing the front left panel 14 and the front right panel 16 in a position using the snap fasteners and/or the drawstring 74 constructed and arranged to provide a gathering of excess material allowing the gown assembly to better conform to the patients body.

An upper edge 60 of the hip cover flap 24 extends from the right depending side edge 26 to the side edge 58, defining an inner surface 62 and an outer surface 64, over lapping the outer surface 31 of the rear panel 12. The hip cover flap 24 is securable at a position adjacent to the left depending edge 52 using a snap 66 that secures to receiver 68 and a snap 69 which secures to receiver 70. A loop 25 is provided to hang urinary catheters or other devices/drains to the gown assembly 10. While the illustrated snaps constitute a preferred embodiment, the number of snaps may vary without departing from the scope of this invention. In addition, or as option to the snap and receiver, a drawstring 74 extending through a tunnel at the upper edge 60 having a first end 76 securable to a second end 78 may be utilized.

A first arm flap 80 is centrally positioned to the seam 18, having a leading edge 82 secured to the left front panel 14 outer edge 32 and an extending edge 84 extending outwardly from the leading edge 82. The first arm flap 80 has a snap fastener 86 which is securable to a receiver 88. A second arm flap 90 is centrally positioned to the seam 20, forming a mirror image to the first arm flap 80. Snap 89 and 91 providing privacy to the chest area when attached.

Figure 5:
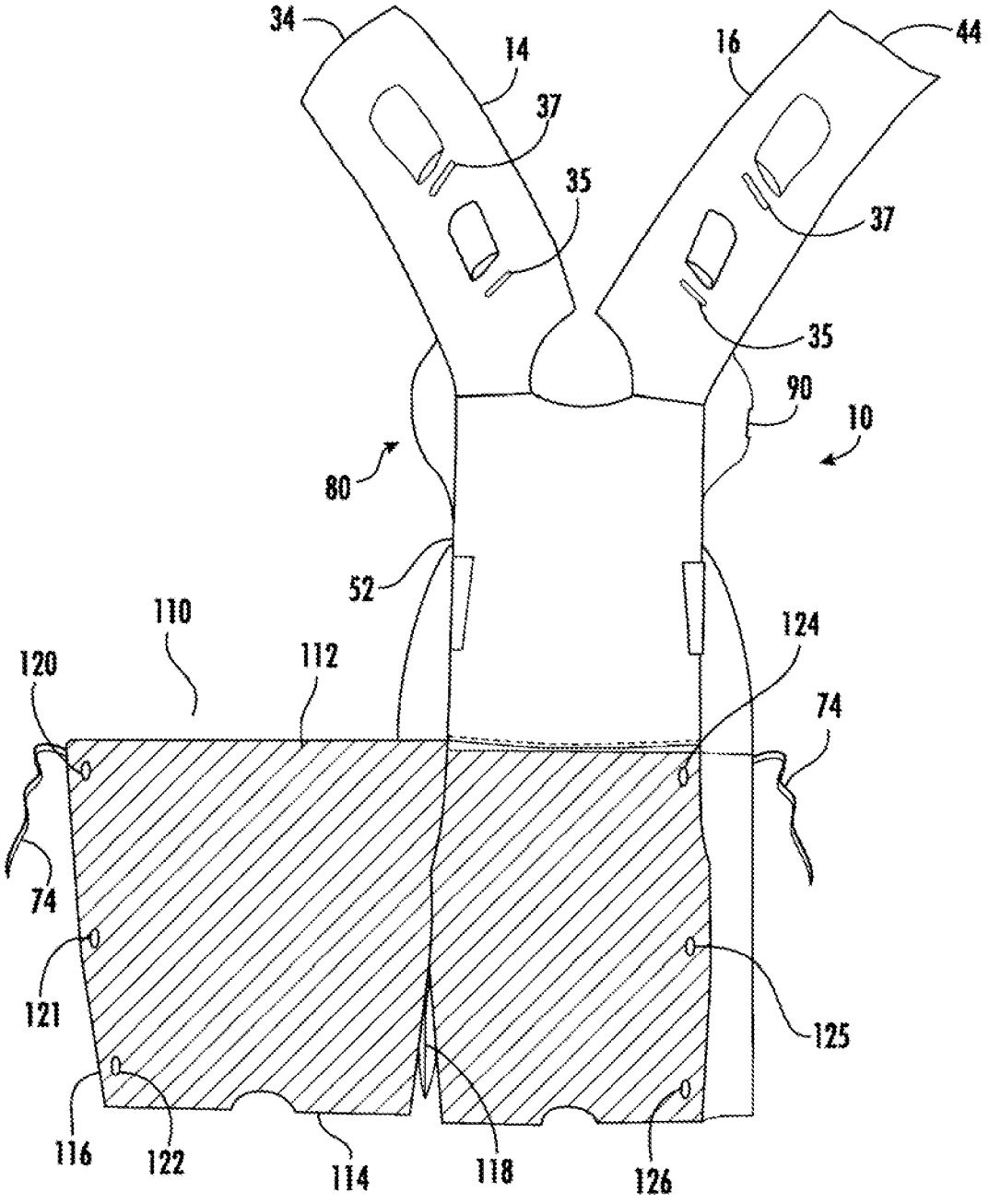
FIG. 5 is a plane view of the gown with short's/wrap in an open position.

FIG. 5 is an open view of the gown 10 having a torso wrap 110. The torso wrap 110 is substantially rectangular, having a top edge 112, bottom edge 114, release edge 116 and attachment edge 118. The attachment edge 118 is secured to the left depending edge 52, wherein the patient can grasp the release edge 116 and attach it to the right depending side edge 26. Snap fasteners 120, 121, and 122 attach to receivers 124, 125, and 126, concealing the patient's torso even if the hip cover flap 24 is in an open position. It is again noted that hook and loop fasteners may replace snap fasteners. Snap fasteners may be inexpensive metal or plastic fasteners suitable for disposal. Snap fasteners mentioned herein are preferably low profile to allow comfort if pushed against the skin, e.g. sitting or sleeping, and are preferably non-metal, making them acceptable for use with MRI devices.

Figure 6:
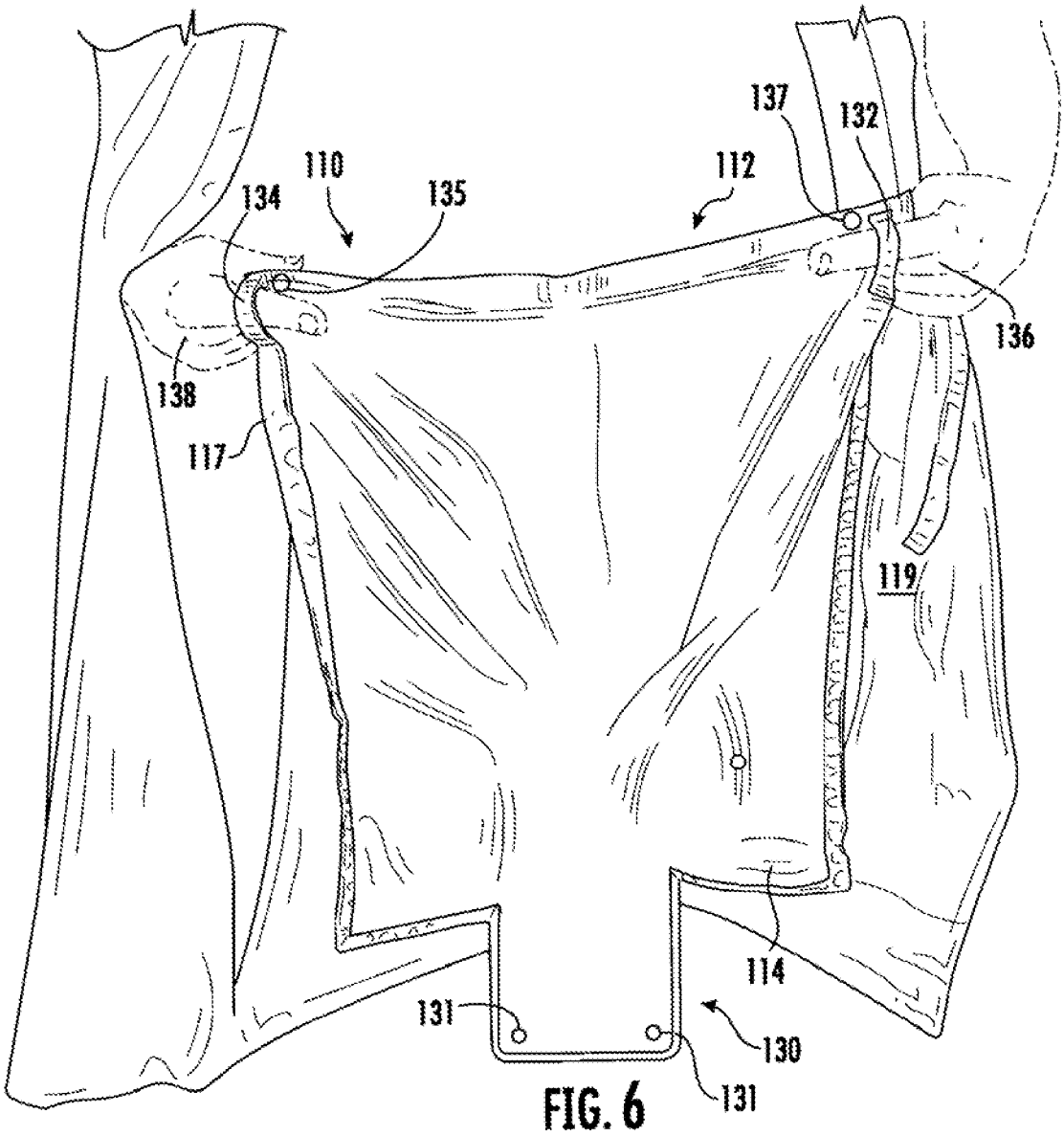
FIG. 6 is a plane view of the gown with faux shorts attached along the lower center.

Referring to FIG. 6, set forth is a torso wrap 110 that is substantially rectangular, having a top edge 112, bottom edge 114, first side edge 117, and second side edge 119. In this embodiment, the bottom edge 114 is attached to the rear panel 12 along the crotch 130 using snaps 131, wherein the patient can grasp the top edge 112 to cover the torso and attach a corner 132, 134 to the back panel 12 using snaps 135, 137, hook and loop, or a drawstring that is pulled through the left and right loops 136, 138.

Figure 7:
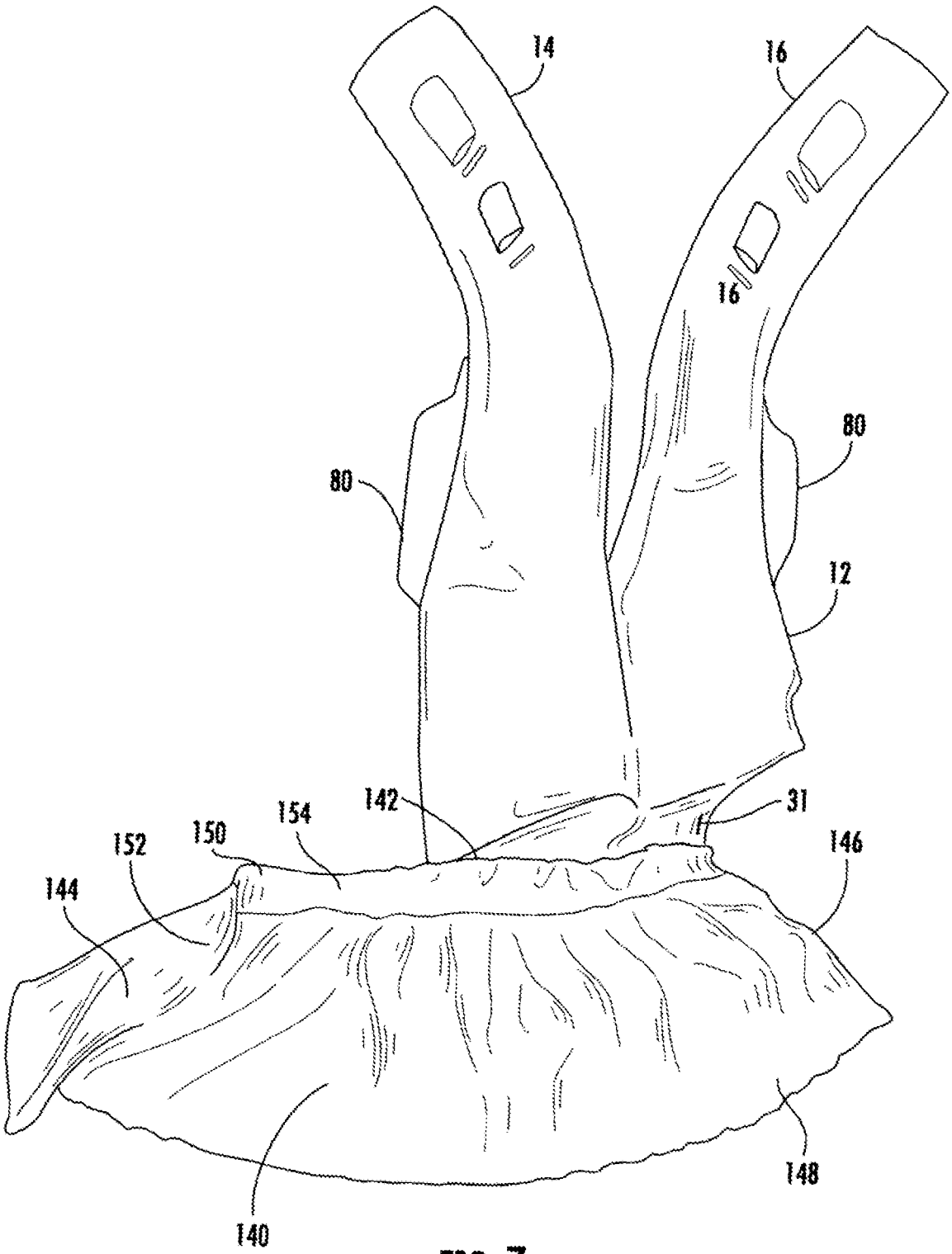
FIG. 7 is a plane view of the gown with a wrap attached to an outer side.
Figure 8:
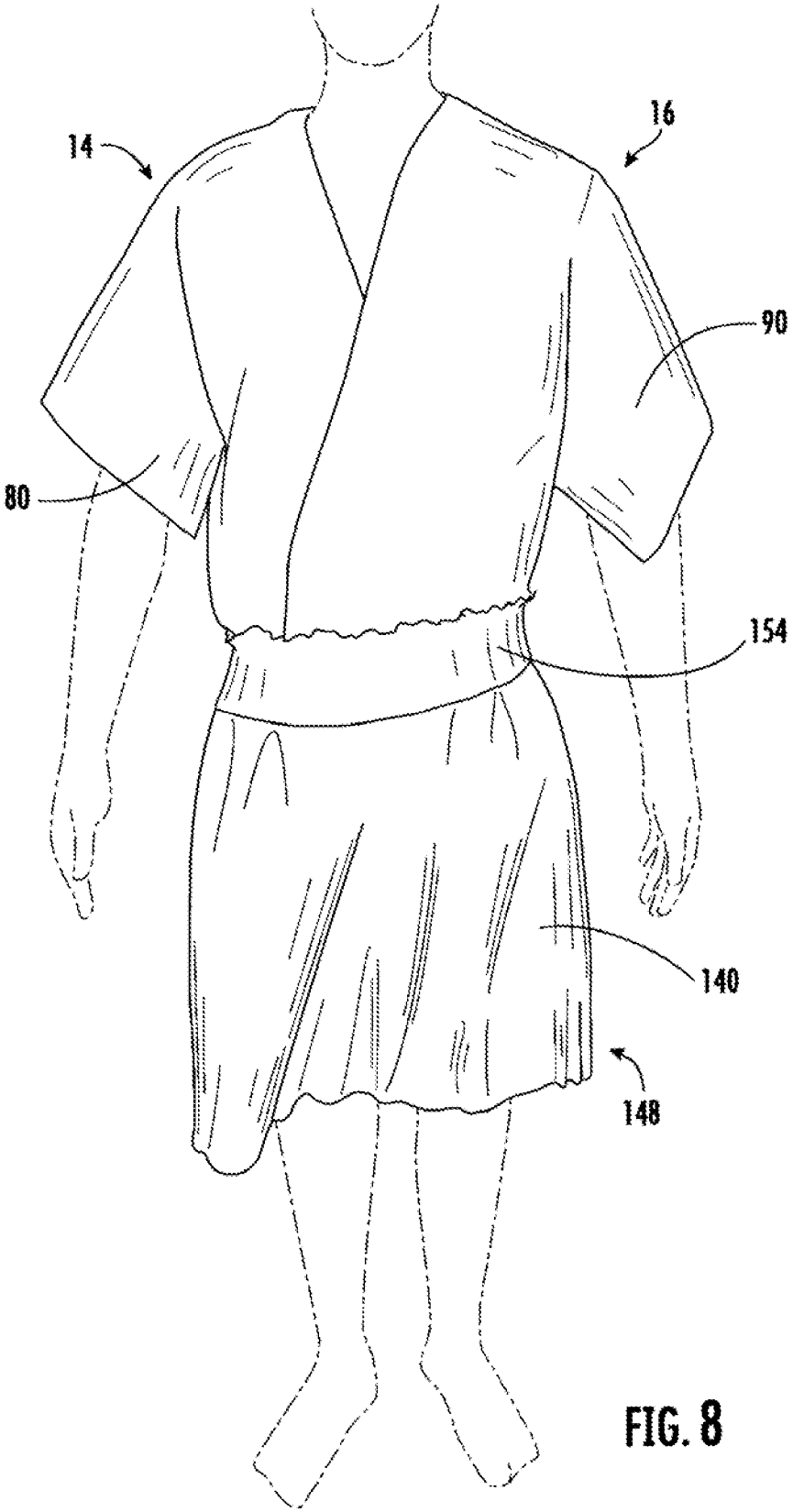
FIG. 8 is a pictorial view of the gown with the wrap secured around a patient.

FIGS. 7 and 8 depict an additional embodiment of the instant invention with a left front panel 14 and a right front panel 16, the panels, pockets and arm flaps 80, 90 remain the same as previously described. A skirt 140 is attached to the outer surface of the rear panel 12; the skirt 140 having a top 142, a lead edge 144, a trailing edge 146, and a skirt edge 148. The lead edge 144 attaches to the outer surface 31 of the rear panel 12. In this embodiment, fastening by hook and loop 150, 152 is preferred as the skirt 140 is primarily decorative. The skirt 140 wraps around a majority of the torso, and the trailing edge 146 attaches to the rear panel 12 employing similar fasteners. It is understood that the skirt 140 could have the leading edge 144 sewn to the rear panel, making it a permanent attachment. However, in the preferred embodiment, the gown 10 is unisex and functional to conceal the patient's body. The skirt 140 can be deemed feminine, as the primary function is aesthetics and concealment is secondary. In this manner, the skirt 140 may include a waist band 154 that may include elastic, and a lower section 148 resembling a conventional skirt design. FIG. 8 shows the gown 10 as worn by a patient, having the right front panel 14 and left front panel 16 tucked into the waistband 154, providing a functional gown that provides the patient with privacy by concealment, yet provides a pleasantly appealing garment that allows the patient to maintain their dignity.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs.

What is claimed is:

1. A patient gown comprising:

a rear panel defined by a left shoulder seam spaced apart from a right shoulder seam by a u-shaped neck edge, a left edge depends from said left shoulder seam to a bottom edge, a right edge depends from said right shoulder seam to said bottom edge;

a left front panel having an upper end permanently and foldably attached to said left shoulder seam, said left front panel defined by an inner edge, an outer edge and a lower end spaced apart from said upper end of said left front panel, said left front panel forming a first inner surface and a first outer surface including a first fastener releasably securing said outer edge of said left front panel to said left edge of said rear panel;

a first arm flap having an edge centrally positioned to said left shoulder seam and extending a length along said left edge of said rear panel and said outer edge of said left front panel, a second fastener releasably securing said first arm flap forming a first sleeve opening;

a right front panel having an upper end permanently and foldably attached to said right shoulder seam, said right front panel defined by an inner edge, an outer edge and a lower end spaced apart from said upper end, said right front panel forming a second inner surface and a second outer surface including a third fastener releasably securing said outer edge of said right front panel to said right edge of said rear panel;

a second arm flap having an edge centrally positioned to said right shoulder seam and extending a length along said right edge of said rear panel and said outer edge of said right front panel, a fourth fastener releasably securing said second arm flap forming a second sleeve opening; and a hip cover flap defined by an upper edge, a bottom edge, an inner side edge foldably attached to a left side of said rear panel and an outer side edge releasably secured to said right side of said rear panel, wherein said hip cover flap overlaps bottom portions of said left and right front panels which extend past the upper edge of said hip cover flap by a minimum length, said lower end of said right front panel and said left front panel are not mechanically attached to the hip cover flap; and a drawstring constructed and arranged to provide a gathering of excess material allowing the gown assembly to better conform to the patient's body; and wherein said left and right front panels extend beyond the upper edge of said hip cover flap in a ratio of at least 3:1.

2. The patient gown according to claim 1 wherein said gown is constructed of a washable and reusable fabric.

3. The patient gown according to claim 1 wherein said gown is constructed of a hospital grade paper.

4. The patient gown according to claim 1 including at least one pocket secured to said first inner surface of said right front panel.

5. The patient gown according to claim 4 including a slit positioned above said at least one pocket, said slit constructed and arranged to allow tubes to pass through said right front panel.

6. The patient gown according to claim 1 including at least one pocket secured to said second inner surface of said left front panel.

7. The patient gown according to claim 6 including a slit positioned above said at least one pocket, said slit constructed and arranged to allow tubes to pass through said left front panel.

8. The patient gown according to claim 1 wherein each said fastener is a snap constructed of plastic or metal.

9. The patient gown according to claim 1 including a fifth fastener constructed and arranged for securing said inner edge of left front panel to said inner edge of said right front panel.

10. The patient gown according to claim 1 wherein said hip cover flap is attached to said rear panel by heat sealing adhesive or sewn.

11. The patient gown according to claim 1 including a pocket secured to said outer surface of said right front panel or said left front panel.

12. The patient gown according to claim 1 including one loop attached to said first inner surface of said right front panel or said second inner surface of said left front panel, said one loop constructed and arranged to support drains.

13. The patient gown according to claim 1 wherein said patient gown is reversible wherein a patient's posterior side is adapted to be easily accessible.

* * * * *